United States Patent [19]

Pollard

[11] Patent Number: 4,718,369

[45] **Date of Patent: * Jan. 12, 1988**

[54] NON-CONDUCTING MAST FOR SAILBOATS

[75] Inventor: Jerry B. Pollard, San Clemente, Calif.

[73] Assignee: Coast Catamaran Corporation, Oceanside, Calif.

[ * ] Notice: The portion of the term of this patent subsequent to Jul. 1, 2003 has been disclaimed.

[21] Appl. No.: 835,642

[22] Filed: Mar. 3, 1986

Related U.S. Application Data

[63] Continuation of Ser. No. 589,511, Mar. 14, 1984, Pat. No. 4,597,346.

[51] Int. Cl.[4] ..... B63H 9/10

[52] U.S. Cl. ..... 114/90; 114/111; 114/39.1

[58] Field of Search ..... 114/90, 204, 108, 112, 114/102, 103, 104, 105, 39; 264/46.9, 257; 52/309.4, 309.9, 727, 728, 730

[56] References Cited

U.S. PATENT DOCUMENTS

| | | | |
|---|---|---|---|
| 3,331,348 | 7/1967 | Dyer | 114/90 |
| 3,429,758 | 2/1969 | Young | 52/725 |
| 3,927,633 | 12/1975 | Bernard | 114/105 |
| 4,072,121 | 2/1978 | Anderson et al. | 114/90 |
| 4,383,955 | 5/1983 | Rubio et al. | 264/257 |
| 4,597,346 | 7/1986 | Pollard | 114/39.1 |

FOREIGN PATENT DOCUMENTS

| | | | |
|---|---|---|---|
| 2942457 | 4/1981 | Fed. Rep. of Germany | 114/90 |
| 8105110 | 6/1983 | Netherlands | 114/90 |
| 1349160 | 3/1974 | United Kingdom | 114/90 |

*Primary Examiner*—Joseph F. Peters, Jr.
*Assistant Examiner*—Edwin L. Swinehart

[57] ABSTRACT

A sailboat mast is provided with a non-conducting upper end portion. The non-conducting portion is formed by wrapping a plastic core with resin-impregnated fiberglass and molding the wrapped core. The lower end of the non-conducting portion is provided with a necked-down portion which is inserted into the upper end of a conventional metal mast. The trailing side of the non-conducting portion has a pair of longitudinally extending grooves, and a plastic luff track includes a pair of attaching flanges which are inserted into the grooves.

14 Claims, 5 Drawing Figures

69
70
71
71
62
68
71

63
76
74
75
73
72
26
27
18
18
10

34
33
19
13
29
11
28
20
30
22
16
12
24
16
23
17
31
14
15

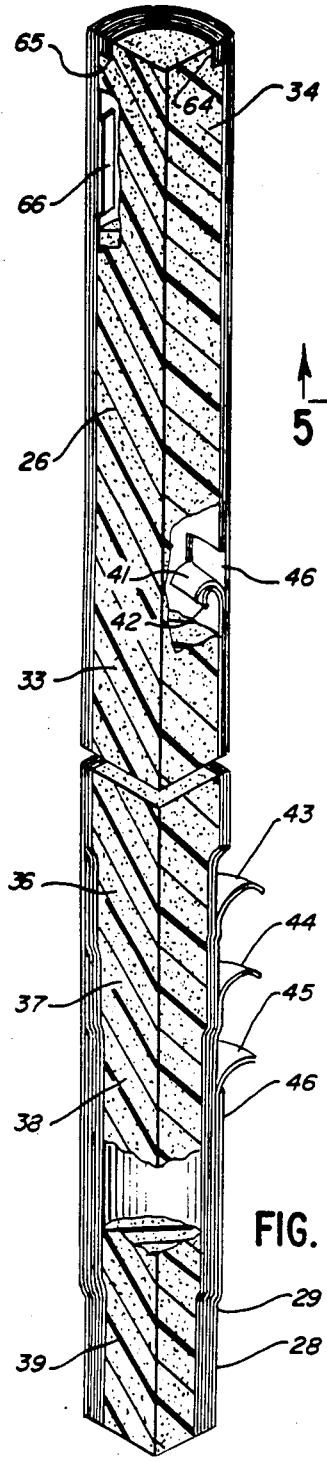
FIG. 4
FIG. 3
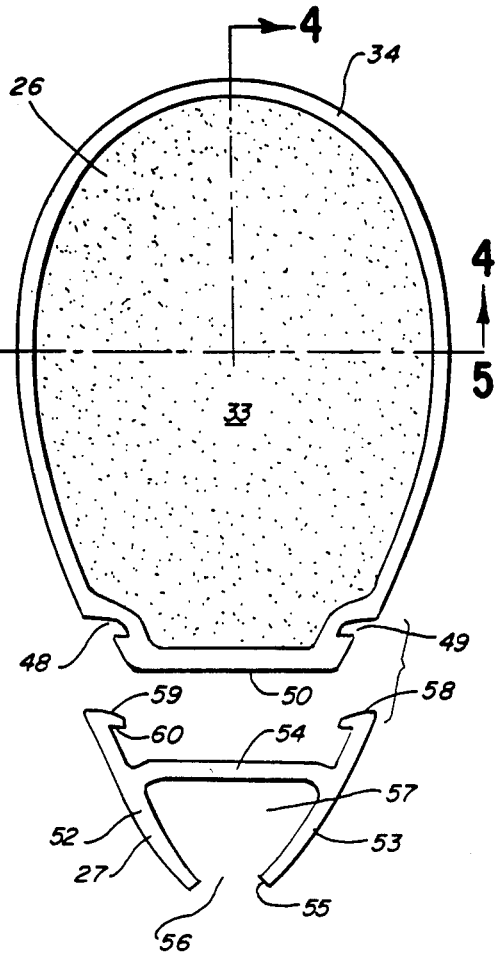
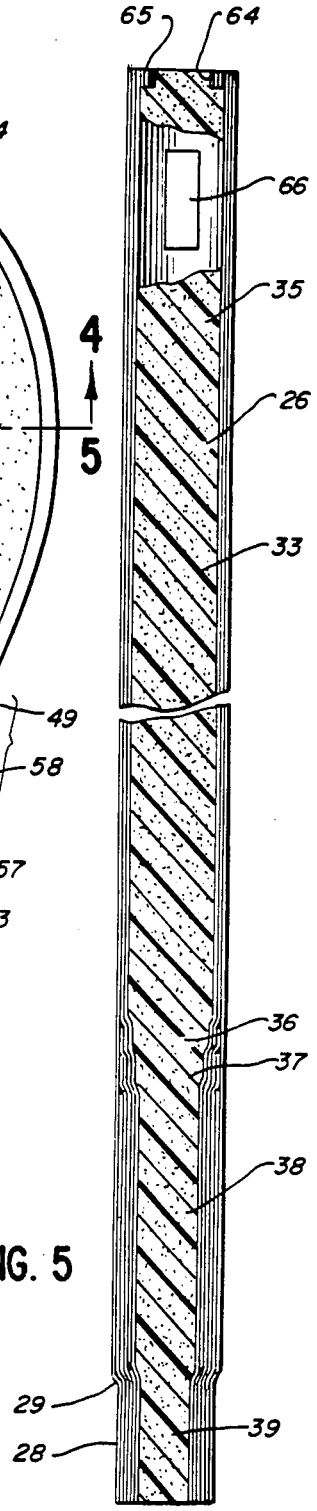
FIG. 5

NON-CONDUCTING MAST FOR SAILBOATS

RELATED APPLICATION

This is a continuation of application Ser. No. 589,511, filed Mar. 14, 1984, now U.S. Pat. No. 4,597,346.

BACKGROUND

This invention relates to sailboat masts, and, more particularly, to a sailboat mast which includes a metal lower portion and a non-metal, non-conducting upper portion.

Sailboat masts are conventionally made of metal in order to withstand the variety of forces which are imposed on the mast. The sail exerts substantial bending and torsion forces on the mast, and the bending forces create both tensile and compressive forces along the length of the mast. The mast is supported by shrouds or stays, and substantial stress is created in the area of attachment between the mast and the shrouds.

A metal mast has an inherent risk of electrical conductivity. If a metal mast contacts low-hanging electrical wires, there is a danger that electricity will be conducted by the mast to the boat and its occupants. Notwithstanding this risk, the great majority of masts have continued to be made of metal because non-conductive materials are not strong enough to withstand the forces which are imposed on the mast.

One attempt to avoid the problem of electrical conductivity is described in U.S. Pat. No. 4,291,639. This patent describes a metal mast which is formed in two sections which are joined by an insulating portion. The shrouds are also provided with insulating portions.

SUMMARY

The invention provides a mast which includes two portions—a conventional metal lower portion and a non-conducting upper portion which is joined to the metal lower portion. The metal lower portion has sufficient strength to withstand the forces which are exerted on the mast, and the metal portion is long enough to permit the shrouds and stays to be attached to the metal portion. The non-conducting upper portion is formed by wrapping layers of resin-impregnated glass fibers around a polyurethane core and molding the wrapped core to the desired shape. A gel coat provides the upper portion with a smooth outer surface. Two longitudinal grooves are provided in the trailing side of the upper portion, and a luff track is attached to the upper portion by flanges which are inserted into the grooves.

DESCRIPTION OF THE DRAWING

The invention will be explained in conjuction with an illustrative embodiment shown in the accompanying drawing, in which

FIG. 3 is a top plan view of the upper portion of the mast and the luff track;

FIG. 4 is a sectional view, partially broken away, taken along the line 4—4 of FIG. 3; and FIG. 5 is a fragmentary sectional view taken along the line 5—5 of FIG. 3.

DESCRIPTION OF SPECIFIC EMBODIMENT

Figures 1, 2:
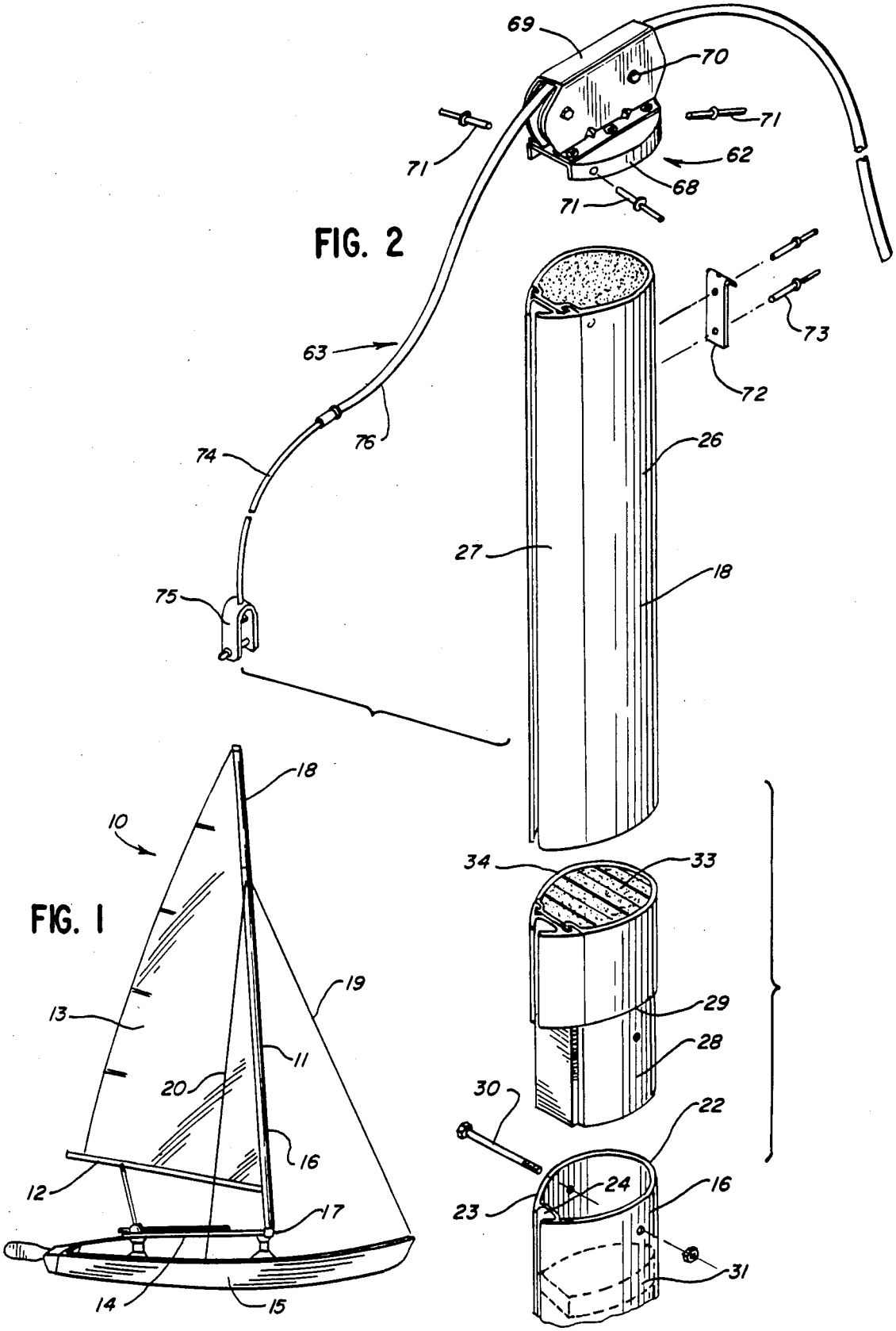
FIG. 1 is a side elevational view of a sailboat equipped with a mast in accordance with the invention.
FIG. 2 is an enlarged exploded perspective view of the upper portion of the mast.

Referring first to FIG. 1, a sailboat 10 includes a mast 11, a boom 12, and a sail 13. The particular boat illustrated is a catamaran, and the catamaran includes a trampoline 14 which is supported by a pair of hulls 15.

The mast is comprised of a lower metal portion 16 which is supported by a crossbar 17 in the conventional manner and an upper non-conducting portion 18. The mast is held upright by a forestay 19 and a pair of shrouds 20. The forestay and shrouds are connected to a mast tang which is attached to the metal portion 16 of the mast.

Referring now to FIG. 2, the metal portion 16 of the mast is a conventional hollow extruded aluminum tube. The aluminum tube has a streamlined cross section provided by a curved leading end 22 and a tapered trailing end 23. A luff rope slot 24 is formed in the trailing end.

The non-conducting upper portion 18 of the mast is formed by an elongated composite body 26 and an elongated extruded plastic luff track 27 (see also FIG. 3). The lower end portion 28 of the composite body is necked down at a shoulder 29, and the necked-down portion is inserted into the open upper end of the aluminum tube 16. The composite body may be attached to the aluminum tube by epoxy, and after the epoxy cures, a bolt 30 is inserted through bolt holes in the aluminum tube and the composite body. A plug 31 may be positioned inside the aluminum tube to prevent water from seeping down the hollow mast.

The composite body 26 includes a core 33 of polyurethane foam and an outer skin 34 of resin-impregnated glass fibers. The polyurethane core is molded to provided an upper portion 35 (FIGS. 4 and 5) of substantially constant cross section and a plurality of stepped portions 36, 37, 38, and 39 which progressively reduce the thickness of the core.

The composite body is formed by wraping two layers 41 and 42 of resin-impregnated glass fibers around the core. The layers 41 and 42 extend along the entire length of the core. A layer 43 of resin-impregnated glass fibers is wrapped around the layer 42 outside of all four of the stepped portions 36–39 of the core. A layer 44 is wrapped around layer 43 outside of the stepped portions 37–39, and a layer 45 is wrapped around layer 44 outside of stepped portions 38 and 39. An outer layer 46 is wrapped around the entire length of the core. In one specific embodiment the fiberglass of layers 41–45 was 17 LG unidirectional "E" glass having a weight of 17 ounces per square yard, and the fiberglass of a layer 46 was a mat of "E" glass having a weight of 1½ ounces per square foot.

A two-part mold is coated with a layer of gel coat, and the fiberglass-wrapped core is pressed in the mold at 150 psi at a temperature of about 170°–180° F. for about four to six minutes. The mold is shaped to provide the composite body with an outer contour of the desired shape, including the necked-down end portion 28, a pair of longitudinally extending grooves 48 and 49 (FIG. 3), and a flat trailing surface 50 between the grooves. The curved outer surface of the composite body corresponds to the contour of the aluminum mast 16.

The fiberglass layers 43–45 compensate for the reduced thickness of the stepped portions, and the thickness of the molded composite body is constant from the shoulder 29 to the upper end. However, a composite body can also be tapered if desired. By varying the length and thickness of the stepped portions and the overlaying fiberglass layers, the weight and strength of the composite body can be varied as desired. In one specific embodiment the total length of the composite body was 93 inches. The stepped portion 39 which is inserted into the aluminum mast was four inches long, the stepped portion 38 was nine inches, the stepped portion 37 was two inches, and the stepped portion 36 was one inch.

The extruded plastic luff track 27 includes a pair of outer walls 52 and 53 which are joined by a connecting wall 54. The trailing ends 55 of the outer walls are spaced apart to provide a slot 56 and a luff rope channel 57. An attaching flange 58 extends inwardly from the leading end of each of the outer walls. Each attaching flange has a curved outer surface 59 and a shoulder 60.

The luff track is snapped into place on the trailing end of the composite body by pressing the attaching flanges against the composite body. The flexible and resilient plastic outer walls flex apart to permit the attaching flanges to move into alignment with the grooves 48 and 49 in the composite body. The outer walls will then snap the attaching flanges into the grooves. The flat trailing surface 50 and the grooves 48 and 49 are preferably coated with adhesive before the luff track is attached.

The luff track 27 stops at the shoulder 29 which defines the necked-down end portion 28 of the composite body. When the composite body is inserted into the aluminum mast, the channel 57 in the luff track is aligned with the luff channel 24 of the aluminum mast, and the outer surface of the composite body conforms to the outer surface of the aluminum mast.

Referring again to FIG. 2, a pulley assembly 62 is attached to the top of the composite body for supporting a halyard 63. In order to reinforce the top of the composite body to permit the pulley assembly to be attached, the top end of the urethane core 33 is provided with an annular recess 64 (FIGS. 4 and 5). Four layers 65 of ½ inch wide resin-impregnated fiberglass tape are wrapped in the recess before the fiberglass layers 41 and 42 are applied. A strip 66 of resin-impregnated fiberglass is applied to the surface of the core before the layers 41 and 42. In one embodiment the fiberglass tape 65 was woven "E" fiberglass having a weight of 6 ounces per square yard, and the strip 66 was "E" mat having a weight of 6 ounces per square foot.

The pulley assembly 62 includes a cap 68, a pulley housing 69, and a pair of pulleys which are rotatably mounted inside the housing on pins 70. The pulley assembly is attached to the composite body by pop rivets 71 which extend through holes in the side wall of the cap 68 and inside holes drilled into the composite body. When the rivets are drawn by the rivet gun, the inner ends of the rivets bear against the fiberglass tape 65.

A metal halyard hook 72 is attached to the composite body by pop rivets 73. The rivets extend through holes which are drilled through the fiberglass strip 66, and the inner ends of the rivets bear against the strip. The upper end of the halyard hook is bent downwardly and is slotted to hold the halyard when the sail is raised.

The halyard 63 includes a wound wire portion 74 which is attached to a shackle 75 and a woven Dacron tube 76 which is attached to the wire. The wire portion of the halyard engages the halyard hook, and the Dacron tube is non-conducting.

The composite body portion of the mast is long enough so that the upper end of the metal portion of the mast is below the minimum allowed height of electrical transmission lines. If the mast contacts such lines, the lines will be contacted by the non-conducting composite portion, and electricity will not be conducted down the mast. On the other hand, the metal portion of the mast is long enough to provide sufficient strength to the mast and to permit the forestay and the shrouds to be attached to the metal portion of the mast.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A sailboat mast comprising an elongated lower metal portion and an elongated composite upper portion, the composite upper portion comprising a longitudinally extending plastic core and at least one layer of resin-impregnated glass fibers surrounding the core, the upper portion being molded to form a pair of longitudinally extending grooves in the outer surface thereof, and a longitudinally extending plastic luff track having a luff rope channel and a pair of attaching flanges extending into said grooves.

2. The mast of claim 1 in which the molded upper portion includes an outer layer of gel coat.

3. The mast of claim 1 in which the upper portion includes a necked-down lower end portion which is inserted into the lower metal portion of the mast.

4. The mast of claim 1 in which the plastic core is molded polyurethane foam.

5. The mast of claim 1 in which the plastic core includes a plurality of stepped portions which increase the thickness of the core as the core proceeds away from the lower metal portion, each stepped portion having a plurality of layers of resin-impregnated glass fibers wraped there around.

6. The mast of claim 1 in which the plastic core has a lower end which is inserted into the lower metal portion of the mast, an upper end, and a plurality of stepped portions which progressively reduced the thickness of the core as the core proceeds downwardly from the upper end toward the lower end, each stepped portion having at least one more surrounding layer of resin-impregnated glass fibers than the next higher portion of the core.

7. The mast of claim 1 in which the lower metal portion extends for more than half of the length of the mast and includes means for attaching shrouds for supporting the mast in an upright position.

8. The mast of claim 1 in which the composite upper portion has a curved outer periphery and said longitudinally extending grooves extend inwardly from said curved outer periphery, said grooves extending generally toward each other to provide retaining services for retaining said attaching flanges in the grooves.

9. The mast of claim 1 in which the lower metal portion has a luff rope channel thereof which is longitudinally aligned with the luff rope channel of the plastic luff track.

10. The mast of claim 1 in which said attaching flanges of the luff track are adapted to be snapped into the grooves in the composite upper portion and each of the attaching flanges includes a curved surface which is adapted to engage the outer surface of the composite upper portion and flex the attaching flanges apart and a shoulder which engages one of the grooves in the composite upper portion to attach the luff track to the composite upper portion.

11. A sailboat mast comprising an elongated lower metal portion and an elongated composite upper portion, the composite upper portion comprising a longitudinally extending plastic core and at least one layer of resin-impregnated glass fibers surround the core, the upper portion being molded to form a curved outer periphery and a pair of longitudinally extending grooves extending inwardly from said curved outer periphery, and a longitudinally extending extruded plastic luff track, the luff track having a pair of outer walls, each of the outer walls having a leading end and a trailing end, the trailing ends of the outer walls being spaced apart to provide a luff slot, a connecting portion extending between the outer walls between the leading and trailing ends thereof, the connecting portion and the trailing ends of the outer walls defining a luff rope channel between the outer walls which is open at said luff slot, and attaching means on each of the leading ends of the outer walls which extend into the grooves in the molded upper portion of the mast.

12. The mast of claim 11 in which the outer walls of the luff track diverge away from each other from the trailing ends to the leading ends.

13. The mast of claim 11 in which each of the attaching means of the luff track comprises a flange which extends from the leading end of one of the outer walls toward the other outer wall.

14. The mast of claim 11 in which each of the outer walls of the luff track is flexible and resilient and each of the attaching means comprises an attaching flange which is adapted to be snapped into the grooves in the composite upper portion, each of the attaching flanges including a curved surface which is adapted to engage the outer surface of the composite upper portion and flex the attaching flanges apart and a shoulder which engages one of the grooves in the composite upper portion to attach the luff track to the composite upper portion.

* * * * *